US005161781A

United States Patent [19]

Sohocki

[11] Patent Number: 5,161,781

[45] Date of Patent: Nov. 10, 1992

[54] TOOL ASSEMBLY FOR USE IN PULLING FENCE POSTS

[76] Inventor: George E. Sohocki, 7771 Sheridan St., Hollywood, Fla. 33024

[21] Appl. No.: 627,340

[22] Filed: Dec. 14, 1990

[51] Int. Cl.[5] ..... E21B 19/00

[52] U.S. Cl. ..... 254/30

[58] Field of Search ..... 269/3, 6, 237; 81/487, 81/300; 254/134, 3 FT, 30, 29 R; 294/113, 114

[56] References Cited

U.S. PATENT DOCUMENTS

| | | | |
|---|---|---|---|
| 1,364,589 | 1/1921 | Schultz | 254/29 R |
| 1,469,911 | 10/1923 | Aumiller | 254/29 R |
| 2,736,532 | 2/1956 | Hughes | 254/134.3 FT |
| 3,119,597 | 1/1964 | Stephens | 254/29 R |
| 4,161,310 | 7/1979 | Parker | 254/30 |
| 4,746,099 | 5/1988 | Lopes | 254/134.3 FT |

FOREIGN PATENT DOCUMENTS

| | | | |
|---|---|---|---|
| 45303 | 2/1974 | Australia | 254/30 |

*Primary Examiner*—Robert C. Watson

*Attorney, Agent, or Firm*—Frank D. Gilliam

[57] ABSTRACT

A tool assembly for use in manually pulling fence posts vertically from the ground. Basically, the assembly includes a first tool having an elongated handle and a bifurcated end sized to fit around a post to be pulled. A pair of hooks extend from the bifurcated end. A second tool basically includes an elongated handle having a transverse rod at one end and a pad adjacent to the transverse rod and extending slightly further from the handle than the rod. In use, the hook end of the first tool is positioned at a substantially perpendicular angle to the post with the hooks extending around the post and pointing upwardly. The rod on the second tool is brought into engagement with the hooks with the second tool angled downwardly from the end. The interlocking ends are slid down the post as the second tool handle is rocked upwardly to a horizontal position with the pad and the base of the hooks engaging the post. As the ends of the handles are lifted to pull the post, the surfaces engaging the post are levered tightly against the post, preventing slippage along the post.

3 Claims, 1 Drawing Sheet

TOOL ASSEMBLY FOR USE IN PULLING FENCE POSTS

BACKGROUND OF THE INVENTION

This invention relates in general to means for pulling fence posts from the earth and, more specifically to a tool assembly allowing convenient manual fence post pulling.

Pulling fence posts or other posts which are well set in the earth has always been difficult. This is particularly true with round metal posts of the sort used to support chain-link fence. In soft earth it is sometimes possible to rock the post sufficiently to allow several men together to pull it. Generally, however, it is too well set and it is necessary to dig the post out. This is a long and tedious task.

If the post cannot be pulled by the physical strength of the worker the post is broken off at ground level wasting the post. Many job related injuries such as, back and hand injuries can be attributed to common inefficient methods now used to pull posts.

In some cases, a chain can be wrapped around a post and an automotive type jack used to engage the chain and lift the post. With metal posts, the chain often slips. In any case this is a slow and difficult process.

Thus, there is a continuing need for improved tools and methods for pulling fence posts.

SUMMARY OF THE INVENTION

It is, therefore, an object of this invention to provide an improved tool assembly which permits rapid, safe and convenient post pulling. Another object of this invention is to provide a fence pulling tool assembly suitable for use with round metal fence posts, T-posts, H-posts, C-section posts and almost all posts used by the highway departments to erect traffic signs. A further object of this invention is to provide a fence pulling tool assembly that can be easily operated by two persons.

The above-noted objects, and others, are accomplished in accordance with this invention by a tool assembly comprising a first tool having an elongated handle and a bifurcated hooked end and a second tool having an elongated handle and a transverse rod at the end adapted to interlock with said hooks. The second tool further includes a transverse pad adjacent to, but extending slightly further than, the transverse rod. The hooks are spaced apart a slightly greater distance than the diameter of the posts to be pulled. When the transverse rod is engaged in the hooks the distance between the pad and the base between the hooks, is preferably substantially equal to the diameter of the posts to be pulled.

Generally, the tool assembly will be sized for one particular post diameter, such as the standard chain-link fence post diameter, or a narrow range of post diameters. A particular tool assembly could, however, be used with somewhat thinner posts than those for which the assembly was optimized simply by placing a suitable metal block between the pad and the post to be pulled.

In use, the first tool is positioned substantially perpendicular to the post with the hooks extending around the post and pointing upwardly. The second tool is angled downwardly from the opposite side of the post with the rod end toward the post. The rod is brought into engagement with the hooks and the interlocked ends are moved along the post to the desired lifting position and the second tool is rocked upwardly until the handles are approximately horizontal and the pad engages the post. Lifting the handles pinches the post between the pad and the hook base with considerable force, so that the handle free ends can be lifted without the assembly slipping along the post.

In general two men may easily pull a post from the earth using this tool assembly. In cases where the post is set in a concrete plug or the earth is unusually tenacious, automotive type jacks could be used engaging the handles to start the post moving. Once the post is broken loose, manually lifting the handles is usually sufficient to complete removal of the post. Great force can be applied through the jacks without the tool slipping on the post, which is not the case with the chain and jack technique discussed above.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
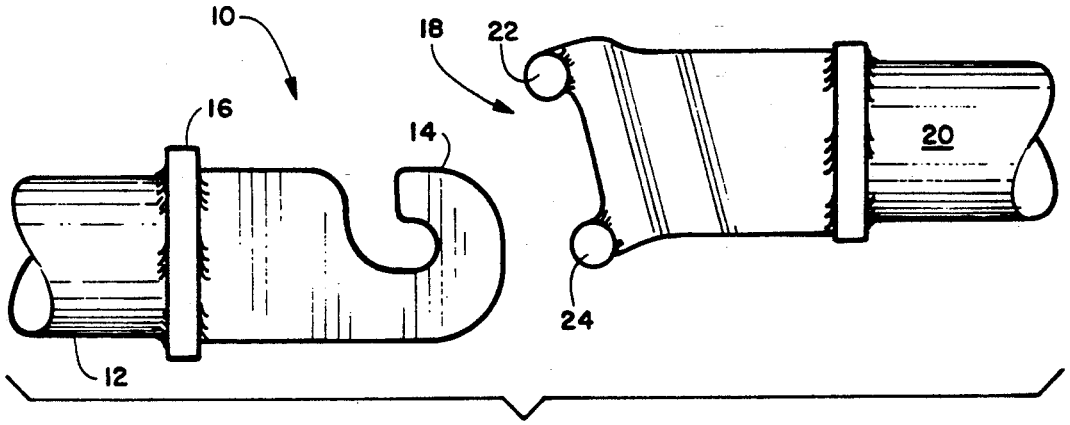
FIG. 1 is general elevation view of the unassembled fence puller tools.
Figure 2:
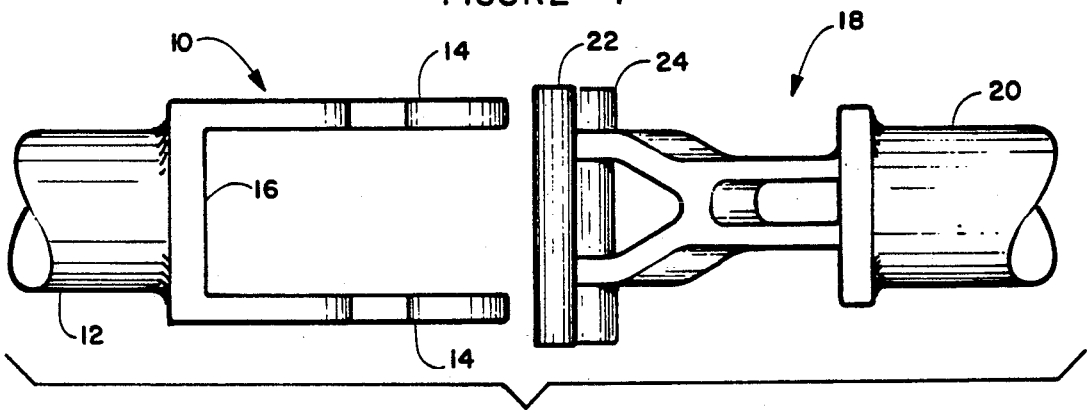
FIG. 2 is a general plan view of the unassembled fence puller tools.

Referring now to FIGS. 1 and 2, there is seen a first tool 10 having an elongated handle 12 and an end fitting which includes a pair of spaced hooks 14 and an intermediate base 16. The space between hooks 14 is equal to, or slightly greater than, the diameter of the posts to be pulled.

Second tool 18 includes an elongated handle 20. An end fitting includes a transverse rod 24 which extends beyond the handle and a pad 22, in this case shown in rod-like shape. Pad 22 may have any suitable shape, although a round shape of any reasonable diameter is preferred. Pad 22 extends further from handle 20 than does transverse rod 24, for reasons which will become apparent.

Figure 3:
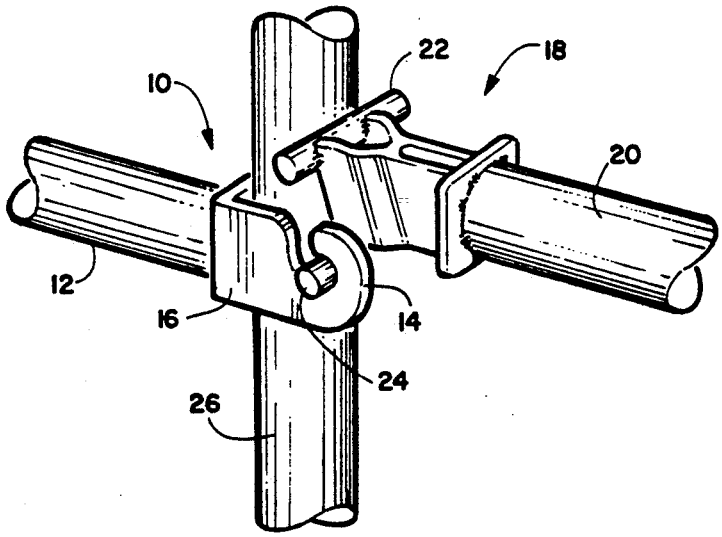
FIG. 3 is a perspective view showing the tool assembly in place on a fence post.

As seen in FIG. 3, first tool 10 is positioned substantially perpendicular to post 26 with hooks 14 on the sides of post 26 and pointed upwardly and base 16 in contact with the post. Second tool 18 is positioned with the fitting end extending at an downward angle so that rod 24 can enter hooks 14. The end of handle 20 is lifted to rock pad 22 into engagement with post 26. If the distance between pad 22 and base 16 has been properly selected and/or if post 26 has the proper diameter, both handles 12 and 20 will extend substantially along a single line, perpendicular to post 26. If the post is slightly large or small, handles 12 and 28 will deviate slightly in a downward or upward direction, although pulling the post will not be significantly adversely affected.

Thus, it can be seen that a highly effective fence post pulling assembly has been provided which is simple, easy and convenient to use. The device may be easily fabricated, generally using weldments of steel pipe, rod and plate.

While specific arrangements, proportions and materials were specified in the above description of a preferred embodiment, those can be varied, where suitable, with similar results. Other variations, applications and ramifications of this invention will occur to those skilled in the art upon reading the present disclosure. Those are intended to be included within the scope of this invention, as defined in the appended claims.

I claim:

1. A tool assemblyf or use in pulling fence posts which comprises:

a first tool comprising an elongated handle, a bifurcated end having a pair of spaced hooks and a base plate therebetween; and a second tool comprising an elongated handle, a transverse pad at one end of said handle, and a transverse rod at said one end of said handle, said transverse pad extends further from said second tool handle than said transverse rod;

said pair of hooks and said transverse rod adapted to interlock around a post with said pad and base in pressure contact with said post.

2. The tool assembly according to cliam 1 wherein the distance between said pad and said base when said tools are interlocked and said handles are positioned along a substantially straight line is substantially equal to the diameter of a post to be pulled.

3. The tool assembly according to claim 1 wherein said pad is in the form of a transverse rod.

* * * * *